US005159233A

United States Patent [19]

Sponseller et al.

[11] Patent Number: 5,159,233

[45] Date of Patent: Oct. 27, 1992

[54] SPARK PLUG AND METHOD FOR ASSEMBLING A SPARK PLUG

[76] Inventors: Harold P. Sponseller, 1752 Valley Way Dr.; Dale L. Byerly, 2138 Glen Arbor Dr., both of Toledo, Ohio 43614

[21] Appl. No.: 605,254

[22] Filed: Oct. 29, 1990

[51] Int. Cl.[5] ..... H01T 13/20; H01T 13/34

[52] U.S. Cl. ..... 313/141; 445/7

[58] Field of Search ..... 313/135, 141; 445/7

[56] References Cited

U.S. PATENT DOCUMENTS

| | | | |
|---|---|---|---|
| 3,668,749 | 6/1972 | Podiak et al. | 445/7 |
| 4,112,330 | 9/1978 | Stimson et al. | 315/46 |
| 4,193,012 | 3/1980 | Podiak et al. | 313/137 |
| 4,249,103 | 2/1981 | Farrell | 313/135 |
| 4,491,101 | 1/1985 | Strumbos | 123/169 C |
| 4,514,656 | 4/1985 | Damson et al. | 313/11.5 |
| 4,643,688 | 2/1987 | Byerly et al. | 445/3 |
| 4,713,582 | 12/1987 | Yamada et al. | 315/58 |
| 4,871,339 | 10/1989 | Sadegh | 445/7 |
| 5,022,881 | 6/1991 | Nagy | 445/7 |

*Primary Examiner*—Sandra L. O'Shea

*Attorney, Agent, or Firm*—Willian Brinks Olds Hofer Gilson & Lione

[57] ABSTRACT

A spark plug (20, 66) which includes a shell (22) having a ground electrode (24) formed integrally therewith into a predetermined final configuration, an annular insulator (34) with a bore (37) extending therethrough, and an electrode (48) positioned within the bore. The insulator is positioned within the opening of the shell by a press fit operation, and the electrode is also positioned within the bore of the insulator by a press fit method.

11 Claims, 5 Drawing Sheets

SPARK PLUG AND METHOD FOR ASSEMBLING A SPARK PLUG

TECHNICAL FIELD

This invention relates to spark plug manufacturing and more particularly to an improved method for assembling a spark plug of the type having a shell with an attached ground electrode, an insulator mounted in the shell and a center electrode assembly mounted in a stepped bore through the insulator. More particularly, this invention relates to an improved method for assembling a spark plug having a shell with an attached ground electrode, an insulator press fit into the shell and a center electrode press fit into a threaded bore of the insulator. This invention also relates to a spark plug with a shell having an attached ground electrode, an insulator press fit into the shell and a center electrode press fit into a threaded bore of the insulator.

BACKGROUND ART

In the conventional methods used for manufacturing spark plugs, a center electrode assembly is mounted in an insulator bore and a ground electrode is welded to a shell prior to the mounting the insulator in the shell. The insulator has a stepped bore in which the center electrode assembly is mounted. The center electrode assembly includes a center electrode having an enlarged diameter head or shoulder which is seated on the insulator bore step, and it further includes a tip which projects from an insulator firing tip or nose for forming a spark gap with the ground electrode on the shell. The center electrode may include an extension above the shoulder. A powdered sealing material, such as talc, is tamped in the annular space between the wire, the center electrode shoulder and insulator to retain the center electrode and to form a seal. Alternatively, a mechanical sealing ring is inserted in place of the powdered sealing material. In one conventional type of spark plug, a terminal is threaded and cemented into the upper end of the insulator bore in contact with the center electrode wire to complete the center electrode wire and thereby to complete the center electrode assembly. In another type of spark plug, a spring and a resistor or an ignition noise suppression element are positioned in the insulator bore and a terminal is threaded and cemented into the upper bore end to complete the center electrode assembly. In that situation the spring is compressed to maintain series electrical continuity between the terminal, the resistor and the center electrode wire. In still another type of spark plug, an electrically conductive or semi-conductive powder is tamped under high pressure in the insulator bore above the head or shoulder on the center electrode. The tamped powder retains the center electrode, forms a seal and maintains electrical continuity in the center electrode assembly. When the tamped material has semi-conducting properties, it also may function as an ignition noise suppressor. A spring is inserted onto the insulator bore and a terminal is threaded and cemented into the upper end of the bore to complete the center electrode assembly. Again, the spring maintains series electrical continuity between the terminal and the tamped powder.

Various methods are used for assembling a spark plug insulator and shell. In one common assembly method, a gasket is positioned on an internal shoulder or step in the shell. The insulator then is positioned in the shell so that a shoulder or flange on the insulator seats on the gasket. A powder sealing material is tamped under high pressure into the annular space between the insulator, the insulator shoulder and the shell to firmly hold the insulator in place and to form a seal. Finally, the upper edge of the shell is rolled inwardly to retain the powder.

In a modified method for assembling the insulator and the shell known as the "hot press" method, the insulator is placed in the shell with a radially extending flange or shoulder seated on a step or shoulder in the shell. A gasket then may be positioned on top of the insulator flange and the upper edge of the shell is rolled inwardly to retain the insulator in the shell. A high electric current is passed longitudinally through the shell to heat a thin walled section, or the thin walled shell section may be inductively heated. While the thin walled section is hot, the shell is pressed and axially collapsed at the thin walled section. The pressure is maintained while the shell cools. During this process, the shell shoulder and/or gasket is deformed slightly by the insulator shoulder to form a seal between the shell and the insulator.

In a "cold press" method of assembling a spark plug insulator in a shell, the insulator is positioned in the shell with a radial flange or shoulder on the insulator seated on a shell shoulder, or on a gasket which is positioned on the shell shoulder, and a powdered sealing material is tamped in the annular space above the insulator flange between the insulator and the shell. The upper end of the shell then is cold rolled inwardly over the upper end of the tamped powder and the shell is axially cold collapsed at a thin walled section by applying a high axial pressure to the shell. The pressure slightly deforms the shell shoulder or the gasket to form a seal between the insulator and the shell. The compressed resilient powder above the insulator shoulder holds the insulator shoulder firmly against the shell shoulder and also forms a seal.

When the insulator and shell are assembled by any of the above methods, a tip of the center electrode assembly projects from the insulator for forming one side of a spark gap. Because of normal manufacturing tolerance variations in manufacturing the center electrode, the insulator and the shell and in assembling these components, there may be considerable variation in the location of the center electrode tip projecting from the insulator. The tolerance variations are corrected by trimming the center electrode tip. After the tip is trimmed, the ground electrode is bent to a final configuration to form a desired spark gap with the center electrode. The tolerance variations which require trimming the center electrode add to the cost of manufacturing the spark plug. Also, trimming the center electrode tip after the center electrode is assembled in the insulator and bending the ground electrode after the insulator assembly is mounted in the shell may place undesirable stresses on the brittle insulator.

Prior art references which disclosed one or more of the foregoing features include U.S. Pat. No. 4,643,688 (D. L. Byerly et al.); U.S. Pat. No. 4,713,582 (Yamada et al.); U.S. Pat. No. 4,514,656 (Dansen et al.); U.S. Pat. No. 4,491,101 (Strumbos); U.S. Pat. No. 4,193,012 (Podiak et al.); and U.S. Pat. No. 4,112,330 (Stimson et al).

DISCLOSURE OF THE INVENTION

This invention relates to an improved method of assembling spark plugs which eliminates the effects of tolerance variations in the shell, the insulator and the center electrode and in their assembly and reduces sources of stress on the insulator during assembly of the spark plug. A ground electrode is attached to a standard shell and is bent to a predetermined final configuration and position. An insulator having a threaded and stepped bore then is mounted in the shell by a new method so that the bore is aligned with a spark gap surface on the ground electrode upon insertion.

The insulator has a shoulder that can be made of various heights to conduct heat into the shell after it is press fit into the shell. The press fit acts as the temperature conducting retained load function and as the seal preventing engine gases from escaping the engine. The insulator does not seat down upon the shell's shoulder. This assembly process allows better head conduction due to larger areas being available if required. The shoulder of the insulator can be straight, or tapered in either direction for best results of sealing and heat conduction and can be tailored to use.

The shell can be the same construction regardless of the seating area of the various insulator designs ranging from hot to cold. Better concentricity results from the press fit. One shell design would suffice for each thread type and thread extension into the engine. This feature would reduce the number of shells required thereby reducing cost and inventory.

The center electrode is made with a press fit shoulder beneath the head at the location best suited for heat conduction to the insulator. It is desirable in this design that the center electrode press fit shoulder be designed within the height of the press fit insulator shoulder to keep maximum insulator strength. The press fit of the insulator in the shell places the insulator shoulder in compression which permits the center electrode to be press fit into the insulator without breaking the insulator. Ceramics have high strength characteristics in compression. The press fit construction of the shell, insulator and center electrode eliminates seals and provides for the ultimate in good concentricity taking advantage of shell and insulator features.

A spark plug produced according to the method of the present invention takes greater advantage of high compression strength of ceramic elements than conventional prior art spark plugs. We recommend a locking taper and/or non-locking taper press fit of the spark plug ceramic insulator into the shell with approximately 0.0005 to 0.020 inch interference fit. This fit along with an extended area or length of interference will permit the engines water jacket to cool the spark plug shell and in turn to permit the heat in the center electrode and ceramic insulator to dissipate heat in a predetermined and controlled fashion. Height, location or position of area of heat transfer can easily be adjusted to the needs of the engine.

After the ceramic insulator is press fit into the spark plug shell, it is held in compression throughout its heat range. We next press fit the center electrode into the already assembled spark plug shell and insulator. The area or length of center electrode interference fit permits the various spark plug heat rating variations. The rating variations also depend upon the press fit location that the insulator and center electrodes measure from the firing end of the spark plug at a lower cost of material and assembly.

Depending where the ceramic insulator is vertically press fit into the shell to best conduct heat, and if the press fit of the center electrode is by chance not at that area, then the following is required. A reduced insulator press fit at the center electrode area reinforces the insulator during the center electrode insertion. A greater press fit of the insulator at the choice location establishes the area to conduct the heat. A reduced insulator press fit at the center electrode area reinforces the electrode during the center electrode insertion. A greater press fit of the insulator at the choice location establishes the area to conduct heat. If necessary, more than one press fit area of the insulator can be used. Since this plug design does not require a cold press or hot lock shell annular groove, the hex could be extended down to the shell seat above the thread body.

Accordingly, it is an object of the present invention to provide a new spark plug. It is a further object of the present invention to provide an improved method of assembling a spark plug. For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
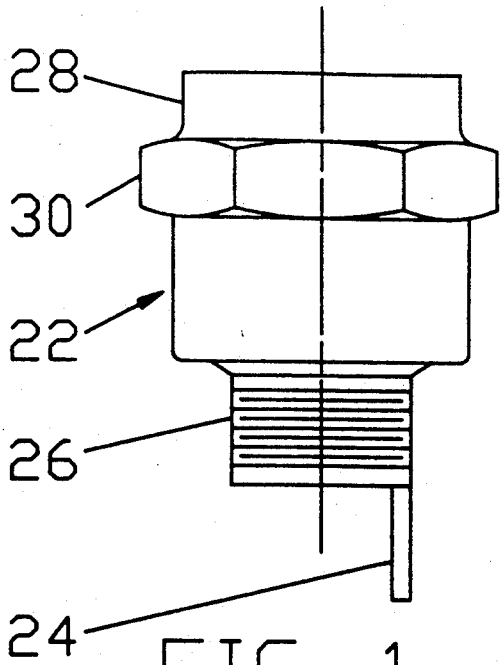
FIG. 1 is a vertical side view of a spark plug shell with an attached but unbent ground electrode.
Figure 2:
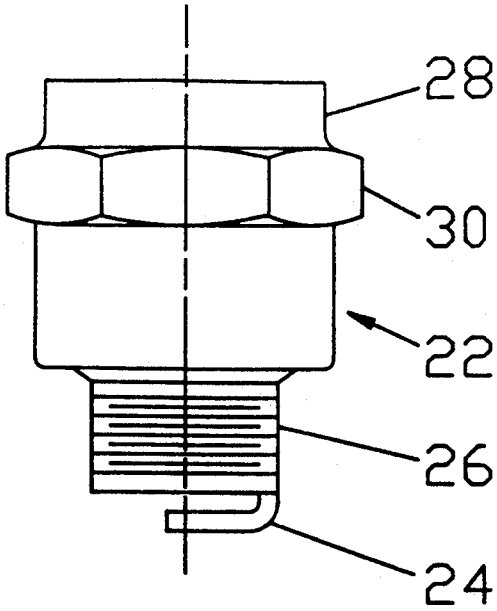
FIG. 2 is a vertical side view of the spark plug shell of FIG. 1, but with the ground electrode bent to a predetermined final configuration and position.
Figure 3:
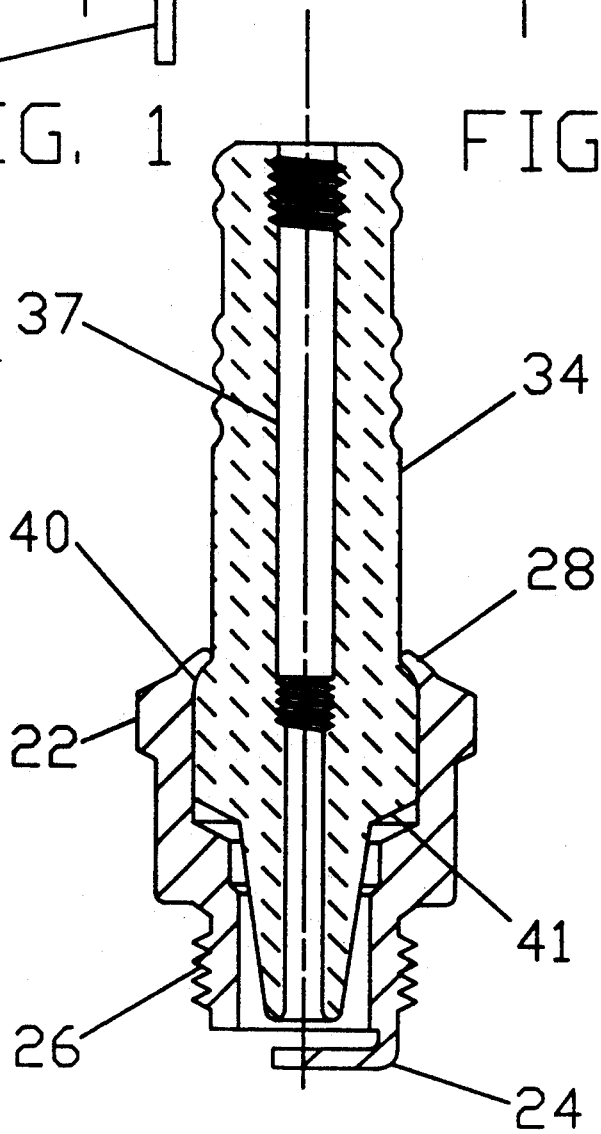
FIG. 3 is a vertical cross sectional view of the spark plug shell of FIG. 2, but with an insulator press fit into the shell bore.
Figure 6:
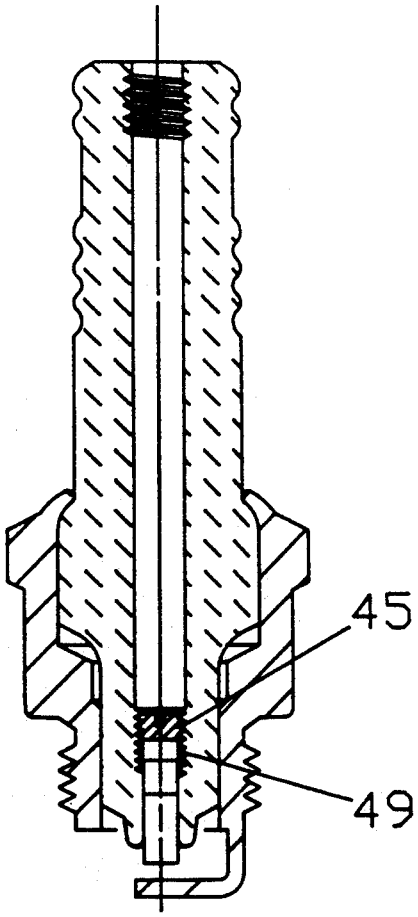
FIG. 6 is a vertical cross sectional view of the spark plug shell, insulator and center electrode of FIG. 3, but with an alternate method of locking in the center electrode by a set screw torqued into the threads of the insulator bore.
Figure 7:
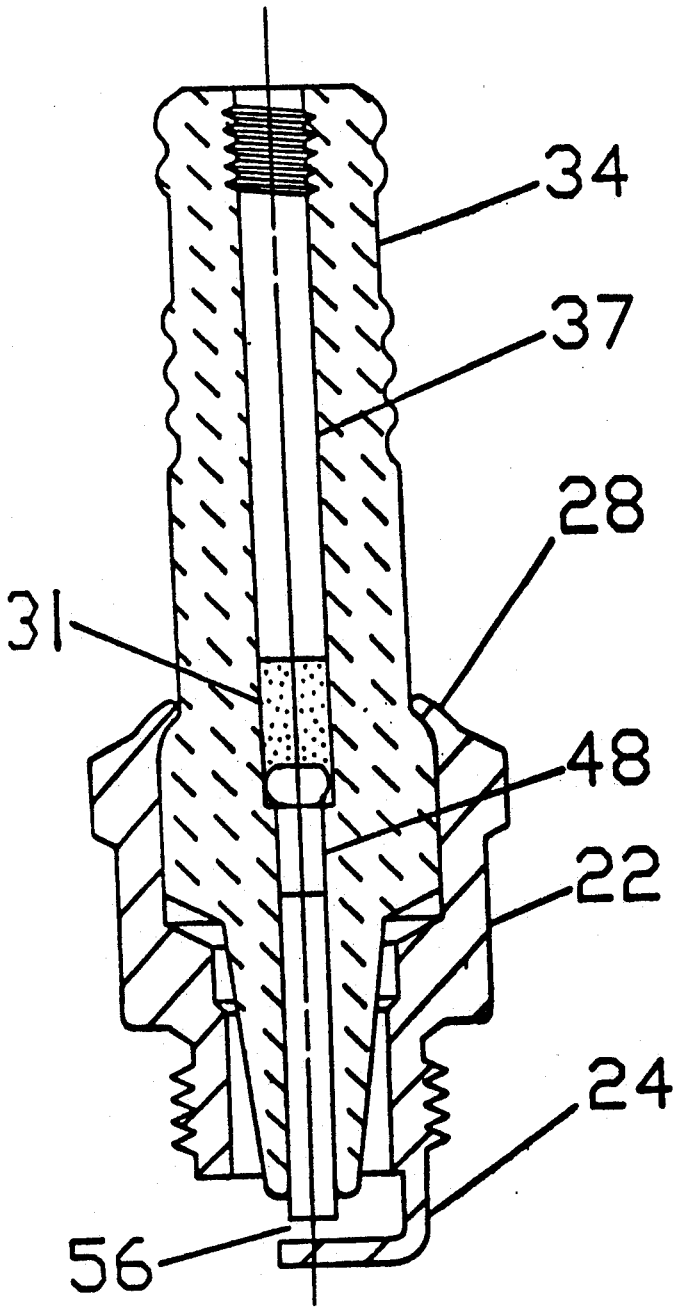
FIG. 7 is a vertical cross sectional view of a spark plug shell, insulator and center electrode of FIG. 3, but showing an alternate method of assembling a spark plug by tamping electrically conductive or semi-conductive powder above the center electrode to retain the electrode.
Figure 8:
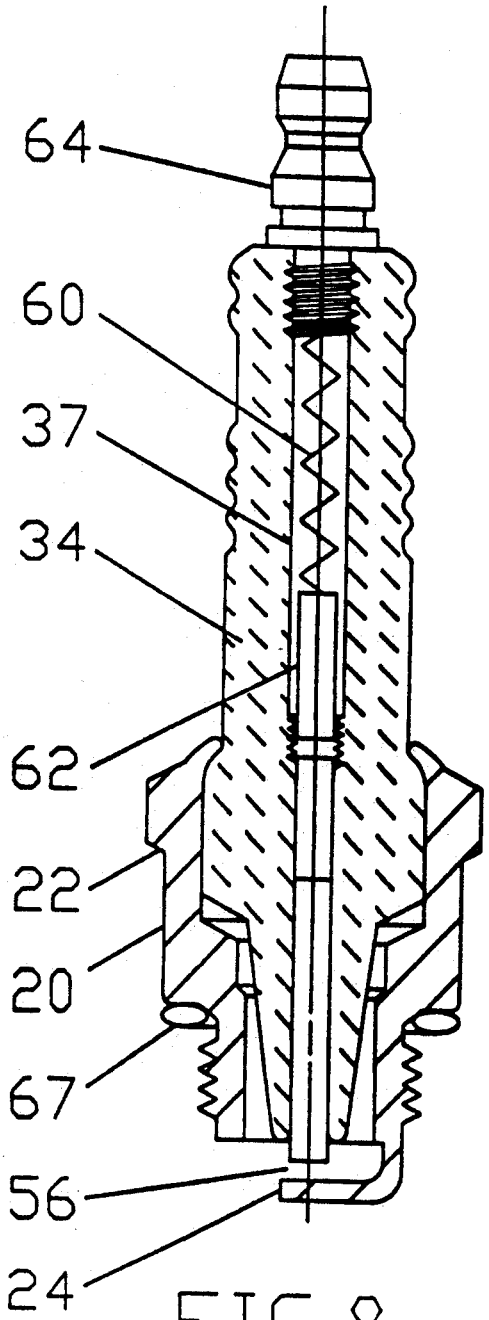
FIG. 8 is a vertical cross sectional view of a completed resistor type spark plug.

FIGS. 1 through 10 illustrate an improved resistor type spark plug 20, FIG. 8. Initially a non-conventional tubular spark plug shell 22 is formed similar to a conventional spark plug shell, but with closer insider diameter tolerances. A straight ground electrode 24 is attached, as illustrated in FIG. 1. As also shown in FIG. 1, the shell 22 has an externally threaded lower end 26 which engages an engine (not shown), an upper sleeve end 28 and an intermediate hexagonal section 30. The ground electrode 24 is bent to a predetermined final configuration and position, as shown in FIG. 2. An insulator 34 is press fit into the shell 22 and is stopped approximately 1/16 inch or more above the shell internal seat, as seen in FIG. 3.

Next a turnover press die turns over the upper sleeve end 28 of the shell 22 and in doing so makes contact with a shoulder 40 of the insulator 34, as seen in FIG. 3. The turnover press die stalls out due to a positive stop with a shoulder bottom 41 of the insulator being 1/32 inch or more above the shell seat, as illustrated in FIG. 3. The above procedure and mechanical lock assures that non-movement of the insulator 34 will result from engine pressures when firing. The press fit of the insulator 34 into the bore of the shell 22 places the ceramic insulator 34 in compression.

Figure 4:
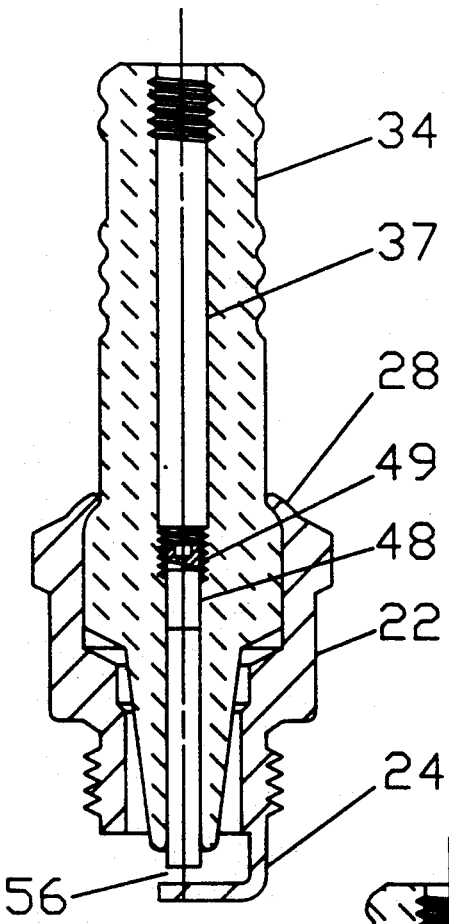
FIG. 4 is a vertical cross sectional view of the spark plug shell, insulators and center electrode of FIG. 3, but showing the cup type head of the center electrode staked into the threads of the insulator bore.
Figure 5:
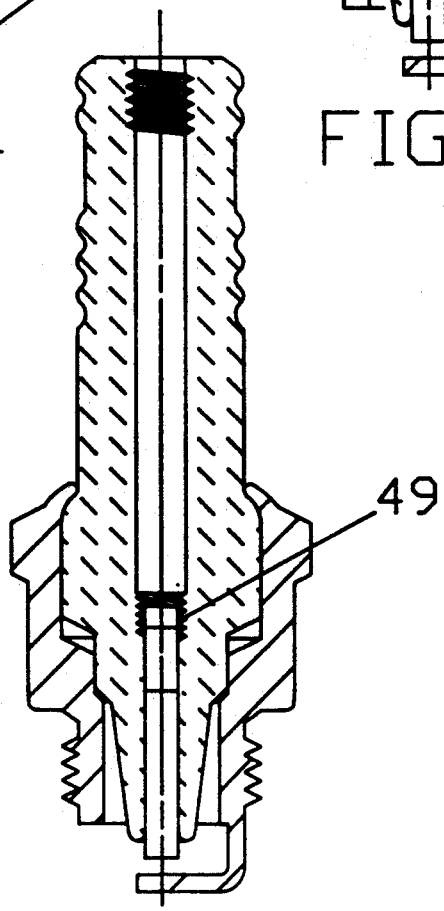
FIG. 5 is a vertical cross sectional view of the spark plug shell and insulator of FIG. 3, but with a center electrode head press fit into the insulator bore in addition to the center electrode body diameter press fit.

Next a center electrode 48 with a shoulder and cup head 49 is press fit into a threaded and stepped bore 37 of the insulator 34, as illustrated in FIGS. 4, 5, and 6 which show various height locations of the center electrode 48. The center electrode 48 is pushed down into the insulator bore 37 until it stalls out against a gap spacer, not shown, forming a spark gap 56 between the bottom tip of the electrode 48 and ground electrode 20. To provide additional push out resistance the center electrode head cup 49 is staked into threads 37 of the insulator bore, as illustrated in FIG. 4. An alternative mechanical lock is to torque a set screw 45 down to the electrode cup head 49, as illustrated in FIG. 6. The electrode cup head 49 can be splined, star shaped or any other fastener configuration to effectively resist push out.

The shoulder 40 of the insulator 34 is held in compression by the sleeve end 28 of the shell 22, providing additional circumferential support for the insulator 34 and its bore 37. It is helpful if the shoulder 49 of the center electrode 48 can be press fit within the insulator shoulder 37 and shell 22 press fit that holds the ceramic insulator 34 in compression giving more ceramic strength when the center electrode shoulder is press fit into the insulator threaded and stepped bore 37.

After the center electrode 48 is fastened in the bore 37 of the insulator 34, the center electrode assembly is completed, as illustrated in FIGS. 4, 5, and 6. Since the exemplary spark plug 20, FIG. 8, is of a resistor type, a spring 60 and a resistor element 62 are inserted in series in the bore 37 of the insulator 34 above the center electrode 48. FIG. 8 shows the spring 60 positioned above the resistor element 62. However, it will be appreciated that the spring 60 may be positioned below the resistor element 62. Finally, a terminal 64 is press fit and cemented into the bore 37 of the insulator 34 and, when needed, a gasket 67 is positioned over a threaded end 26 of the shell 22 to complete assembly of the spark plug 20. When the terminal 64 is attached to the insulator 34, the spring 60 is compressed to maintain electrical continuity in the center electrode assembly.

Figure 9:
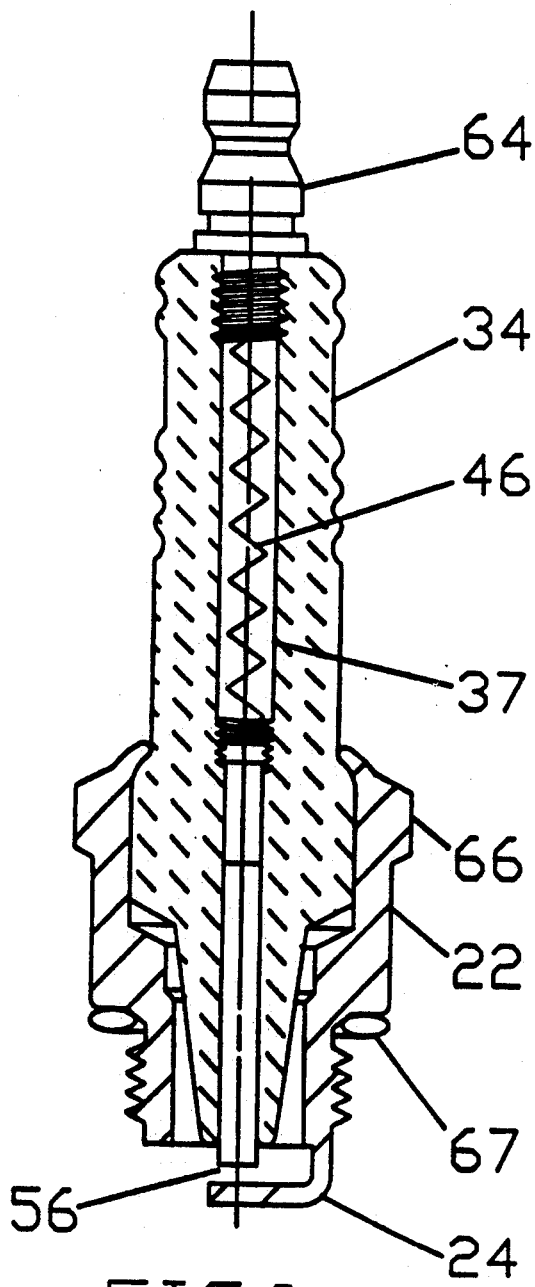
FIG. 9 is a vertical cross sectional view of a completed non-resistor type spark plug.

The spark plug assembly method is equally applicable to the manufacture of a conventional non-resistor type spark plug 66, as shown in FIG. 9. The initial steps of the method are the same as those shown in FIGS. 1 through 6 for the spark plug 20. The only difference is that the spark plug 66 has spring 46 which is longer than the spring 60 to compensate for the eliminated resistor element 62. The insulator 34 is mounted in the shell 22 having the attached and preformed ground electrode 24, as illustrated in FIGS. 1 through 3. An alternative assembly would provide that a tamped seal be used to increase the push out value of the center electrode.

Figure 10:
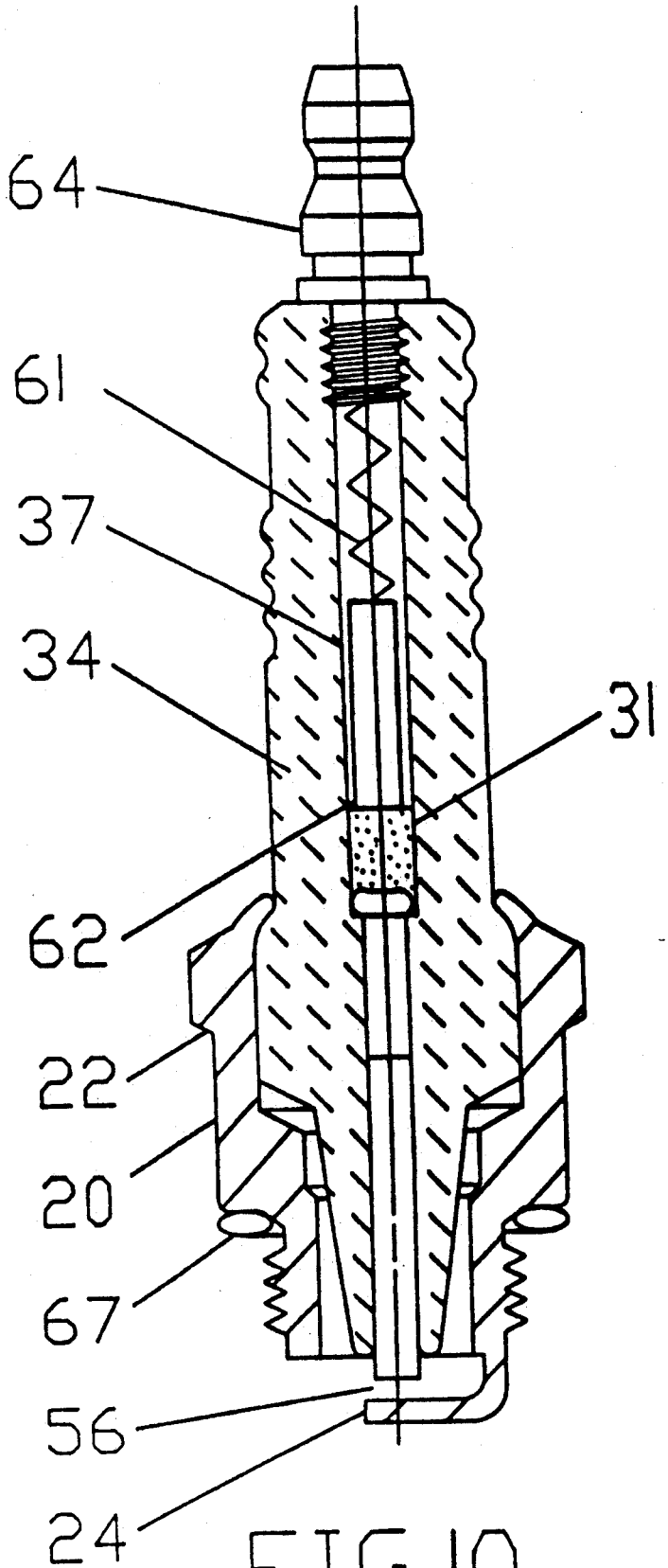
FIG. 10 is a vertical cross sectional view of completed resistor type spark plug of FIG. 8, but with the alternate method of assembling a spark plug by tamping electrically conductive or semi-conductive powder above the center electrode to retain the electrode.

As is illustrated in FIGS. 7 and 10, alternative techniques for assembling a spark plug are as follows:

The electrode is press fit into the insulator bore and electrically conductive or semi-conductive powder 31 is tamped at a high pressure in the bore 37 above the center electrode shoulder to retain the electrode 48. When the powder is a semi-conductor, a predetermined quantity may be tamped into the insulator bore to provide desired ignition noise suppression properties. In the embodiment of FIG. 10 a spring is added above the tamped powder and a terminal is threaded and cemented in the end of the insulator bore.

It will be appreciated that various known methods may be used for mounting the spark plug insulator in the shell and for mounting the center electrode in the insulator.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A spark plug comprising:

a shell with an opening therein;

a ground electrode, said ground electrode being formed integrally in a single piece with said shell and having a portion extending generally transversely of said opening, said portion having a predetermined final configuration and position and having a spark gap portion thereon;

an insulator, said insulator being securely retained in said opening of said shell, said insulator having a bore extending therethrough, said bore being aligned with said portion of said ground electrode; and a center electrode, said center electrode being securely retained in said bore and having a tip portion, said tip portion forming a spark gap with said spark gap portion of said portion of said ground electrode;

said insulator being in circumferential compression and at least a portion of said center electrode being in circumferential compression.

2. A spark plug according to claim 1, said spark plug being free of a tamped powder or glass seal and being assembled without a hot lock process.

3. A spark plug according to claim 1, said spark plug being free of any ball joint effect.

4. A spark plug according to claim 1 wherein said insulator is press fit in said opening of said shell, and wherein said center electrode is press fit in said bore of said insulator.

5. A spark plug according to claim 1, said spark plug being free of an internal gasket and being free of any iron wire leading to said center electrode.

6. A spark plug according to claim 5 wherein said center electrode is formed from nickel or a nickel alloy.

7. A spark plug according to claim 4 wherein said bore of said insulator has a first, smaller portion positioned nearer to said ground electrode, a second, larger portion positioned further from said ground electrode, and an annular step at a juncture between said smaller portion and said larger portion, and wherein said center electrode has a portion in engagement with said annular step of said bore of said insulator to precisely position said center electrode relative to said portion of said ground electrode.

8. A spark plug according to claim 1 wherein said insulator has an outer, annular shoulder, a marginal portion of said shell being turned in against said outer, annular shoulder after insertion of said insulator into said shell.

9. A method for assembling a spark plug, the spark plug having a shell with an opening therein, a ground electrode formed integrally in a single piece with the shell and having a portion extending generally transversely of the opening, an insulator with a bore extending therethrough, and a center electrode, the insulator having an outside diameter which is at least slightly larger than an inside diameter of the opening of the shell, the center electrode having a portion with an outside diameter which is at least slightly larger than an inside diameter portion of the insulator, said method comprising:

inserting the insulator in the opening of the shell by a press fit method; and inserting the center electrode in the bore of the insulator with the portion of the center electrode being engaged by the portion of the bore of the insulator, the step of inserting the center electrode being done by a press fit operation.

10. A method according to claim 9 wherein said insulator has an outer, annular shoulder, and further comprising:

turning in a marginal portion of the shell against the outer, annular shoulder of the insulator.

11. A spark plug according to claim 1 wherein said shell has an externally threaded lower end.

* * * * *